United States Patent [19]

Gaubert

[11] Patent Number: 4,534,154

[45] Date of Patent: Aug. 13, 1985

[54] METHOD AND MACHINE FOR FILLING BAGS WITH LIQUID

[76] Inventor: Rene J. Gaubert, 4219 Oakmore Rd., Oakland, Calif. 94602

[21] Appl. No.: 493,429

[22] Filed: May 10, 1983

[51] Int. Cl.[3] ..... B65B 3/04

[52] U.S. Cl. ..... 53/458; 53/468; 53/469; 53/479; 53/268; 53/570; 53/434; 53/512; 141/10; 141/114; 383/94

[58] Field of Search ..... 53/266 R, 268, 386, 53/434, 458, 468, 469, 512, 562, 570, 479; 141/10, 68, 114, 166, 317, 318; 383/66, 94, 906

[56] References Cited

U.S. PATENT DOCUMENTS

| | | | |
|---|---|---|---|
| 2,307,902 | 1/1943 | Vogt et al. | 383/66 |
| 2,708,067 | 5/1955 | Paton | 383/48 |
| 2,861,406 | 11/1958 | Holsman et al. | 53/459 |
| 3,245,200 | 4/1966 | Shaw . | |
| 3,261,379 | 7/1966 | Stockel et al. | 141/10 |
| 3,894,381 | 7/1975 | Christine . | |
| 4,055,032 | 10/1977 | Hammond . | |
| 4,077,182 | 3/1978 | Papaluca . | |
| 4,120,134 | 10/1978 | Scholle . | |
| 4,274,554 | 6/1981 | Malpas . | |

FOREIGN PATENT DOCUMENTS

| | | | |
|---|---|---|---|
| 1387811 | 9/1961 | France | 53/469 |

*Primary Examiner*—John Sipos
*Assistant Examiner*—Donald R. Studebaker
*Attorney, Agent, or Firm*—Flehr, Hohbach, Test, Albritton & Herbert

[57] ABSTRACT

The present method comprises the steps of positioning a bag on a supporting surface, the bag consisting of flexible film material such as plastic laminate. The bag is so constructed that its side walls are sealed along their peripheries, with one end having an unsealed portion. A filling hole is provided in one side wall of the unsealed bag portion. The bag before filling is flat, or in other words it is not inflated with air or other gas. The side walls of the unsealed portion (preferably a corner of the bag) are then separated to form an opening into which means is introduced to effect sealed registration of a filling head with the bag filling hole. A measured amount of liquid is then delivered through the filling opening to fill the bag, and after the bag has been filled the unsealed end portion of the bag is heat sealed to form a completely sealed bag. Before filling, it is desirable to evacuate air from the bag by applying suction. The machine for carrying out the foregoing method in an automated fashion, consists of one or more operating assemblies each having means for opening one end portion of the bag, means for establishing sealed registration of the filling opening with a filling head, means for supplying liquid through the filling head to carry out the filling operation, and means for releasing the bag after the filling and sealing operations. The machine may be fed with prefabricated bags, or it may be fed automatically from a bag fabricating machine.

19 Claims, 20 Drawing Figures

METHOD AND MACHINE FOR FILLING BAGS WITH LIQUID

This invention relates generally to methods and machines for filling bags or pouches with various liquids, particularly bags made of flexible film material (e.g. plastic laminate, metalized plastic or metallic films).

Reference is made to my co-pending application Ser. No. 390,191 filed June 21, 1982 and entitled Method and Machine for Filling Pouches With Liquid, which discloses features that are disclosed in the present application.

Bags or pouches of the above type are used extensively for marketing wine and other liquids in packages. The package as marketed may consist of a fiber board carton in which the filled and sealed bag is disposed. By various means the purchaser dispenses the liquid through a spigot or tap. In some instances the tap is attached to the bag before the bag is filled. With some carton assemblies the bag has an annular dispensing fitting to which the tap is coupled by the consumer, the fitting being secured to the bag in such a fashion as to provide a sealing membrane which is ruptured when the tap is applied. Another type of tap assembly disclosed in U.S. Pat. No. 4,314,654 Feb. 9, 1982 employs a tap that is pivotally mounted within the carton and which is swung to an operating position exterior of the carton by the consumer.

Various methods have been used for filling such bags. One method (see U.S. Pat. No. 4,077,182, Mar. 7, 1978) introduces the liquid through one open end of the bag, after which the open end is heat-sealed. Another prior method employs a filling fitting that is attached to the bag, and which is coupled to a filling head for the liquid filling operation. After completing filling of the bag the opening through the fitting is sealed. The methods just described may be carried out manually, semi-manually, or in automated fashion. As disclosed in Shaw, U.S. Pat. No. 3,245,200 Apr. 12, 1966, a special head assembly is engaged with one wall of the sealed bag by suction, and thereafter the wall portion surrounded by the suction head is pierced to permit liquid to be applied. As disclosed in U.S. Pat. No. 4,055,032 Oct. 25, 1977, tube forming bag making machines have been adapted for application of fittings, and filling and sealing operations.

The methods and machines described above have certain objectionable features. Manual and semi-manual methods require a substantial amount of manual labor which increases the overall cost of the package. Many of the methods and machines that have been developed have certain disadvantages, such as the necessity of employing a filling fitting on the bag, and lack of adaptability to manual, semi-automated or fully automated operations.

In general it is an object of the present invention to provide an improved method and machine for filling such bags with wine or other liquids, or other products.

Another object is to provide a novel bag filling method and machine which is capable of relatively high production capacity.

Another object is to provide a novel method and apparatus which does not require that the bag have a filling fitting for use in carrying out filling of the bag.

Another object is to provide a novel method and means for establishing sealed registration between a filling opening in one side wall of the bag and a filling head.

Another object is to provide a novel system in which bags are made and then immediately and automatically filled with liquid and sealed. In such a system, an automatic bag making machine is coordinated with an automatic bag filling machine.

The present method comprises the steps of positioning a bag on a supporting surface, the bag consisting of flexible film material such as plastic laminate. The bag is so constructed that its side walls are sealed along their peripheries, with one end having an unsealed portion. A filling hole is provided in one side wall of the unsealed bag portion. The bag before filling is flat, or in other words it is not inflated with air or other gas. The side walls of the unsealed portion (preferably a corner of the bag) are then separated to form an opening into which means is introduced to effect sealed registration of a filling head with the bag filling hole. A measured amount of liquid is then delivered through the filling opening to fill the bag, and after the bag has been filled the unsealed end portion of the bag is heat sealed to form a completely sealed bag. Before filling, it is desirable to evacuate air from the bag by applying suction. The machine for carrying out the foregoing method in an automated fashion, consists of one or more operating assemblies each having means for opening one end portion of the bag, means for establishing sealed registration of the filling opening with a filling head, means for supplying liquid through the filling head to carry out the filling operation, and means for releasing the bag after the filling and sealing operations. The machine may be fed with prefabricated bags, or it may be fed automatically from a bag fabricating machine.

Additional objects and features of the invention will appear from the following description in which the preferred embodiment has been set forth in detail in conjunction with the accompanying drawing.

REFERRING TO THE DRAWINGS

Figure 1:
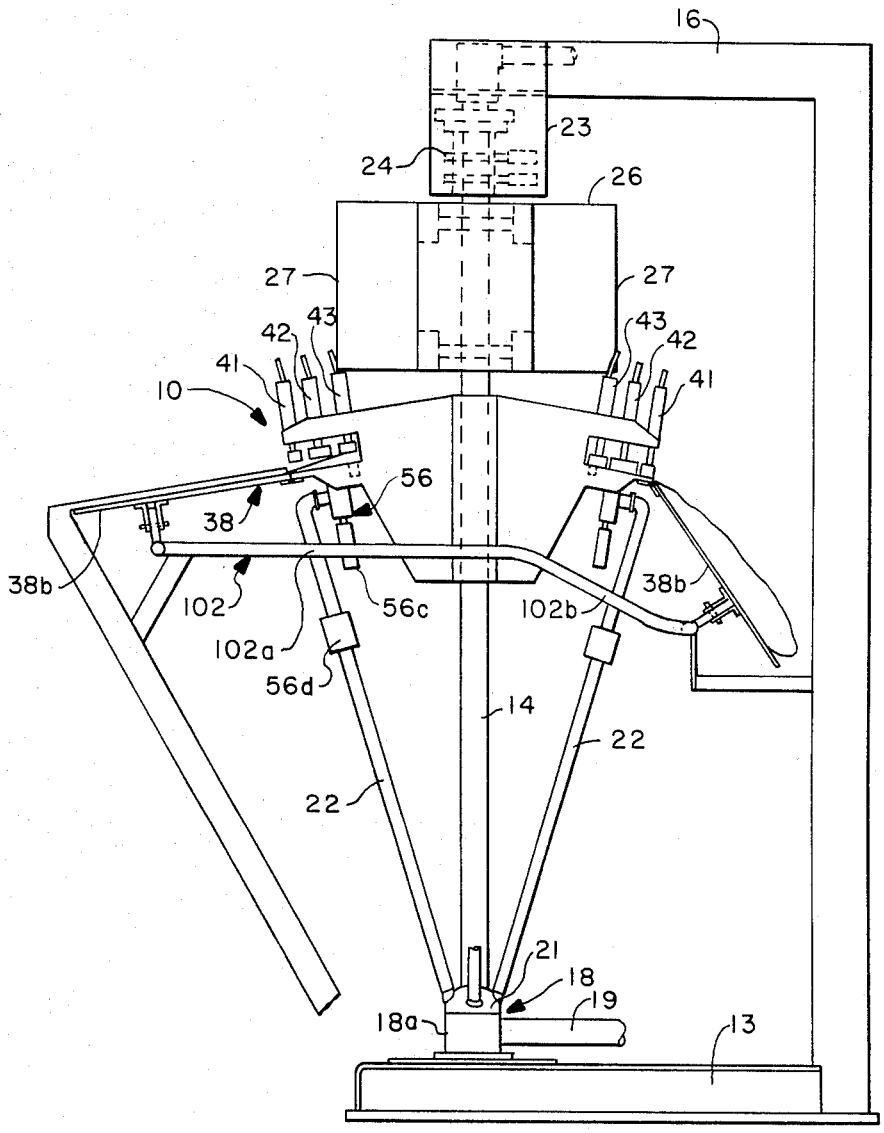
FIG. 1 is a side elevational view schematically illustrating a machine incorporating the present invention.

The machine illustrated in FIG. 1, taken together with the schematic plan view 15, is of the rotary type, and is provided with a plurality of operation assemblies 10, which are disposed about a central vertical axis. The feed station where bags or pouches are fed to the machine is indicated by arrow 11, and the discharge station where filled bags are discharged from the machine, is indicated at 12. In the particular embodiment illustrated, each assembly 10 is indexed successively through four positions about the vertical axis of the machine, starting at the feed station 11, indexing through 90° quadrants, with discharge at station 12, and returning to the feed station 11. The base 13 serves to support the various working parts of the machine. A vertical pipe 14 is rotatably carried by the base 13 and its upper end is journaled to the stationary arm 16, which is fixed to the upper end of the structural member 17. At the lower end of the pipe 14 there is a rotary valve 18, having a body 18*a* that is mounted on the base 13, and which has an inner chamber in communication with the in-flow pipe 19. The rotary portion 21 of the valve 18 communicates with the lower ends of the pipes 22.

An enclosure 23 is shown surrounding the upper end of the pipe 14, and is carried by the support arm 16. It encloses cam controlled electrical switches which serve to program various phases of the operating cycle. Below the enclosure 23 there is a structure 26 having four portions 27 each of which is associated with an operating assembly.

Figure 2:
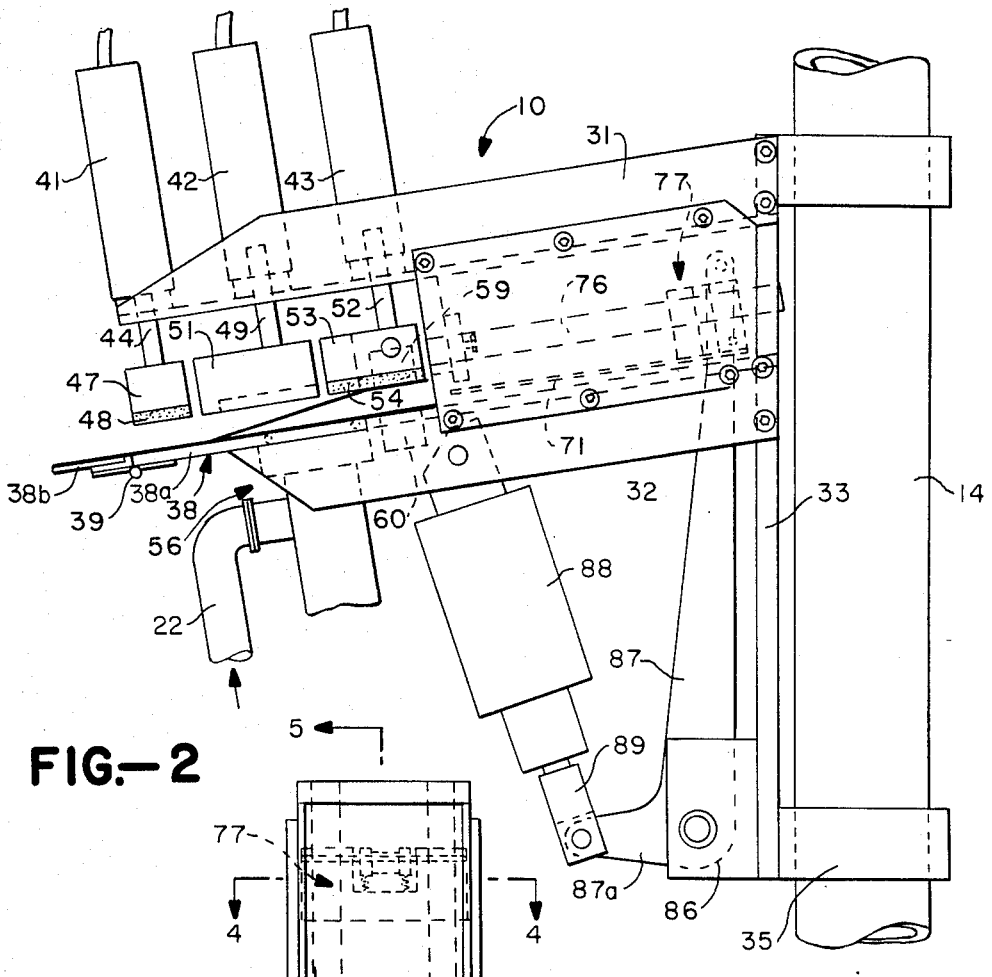
FIG. 2 is an enlarged detail in side elevation illustrating an operating assembly of working parts.
Figure 3:
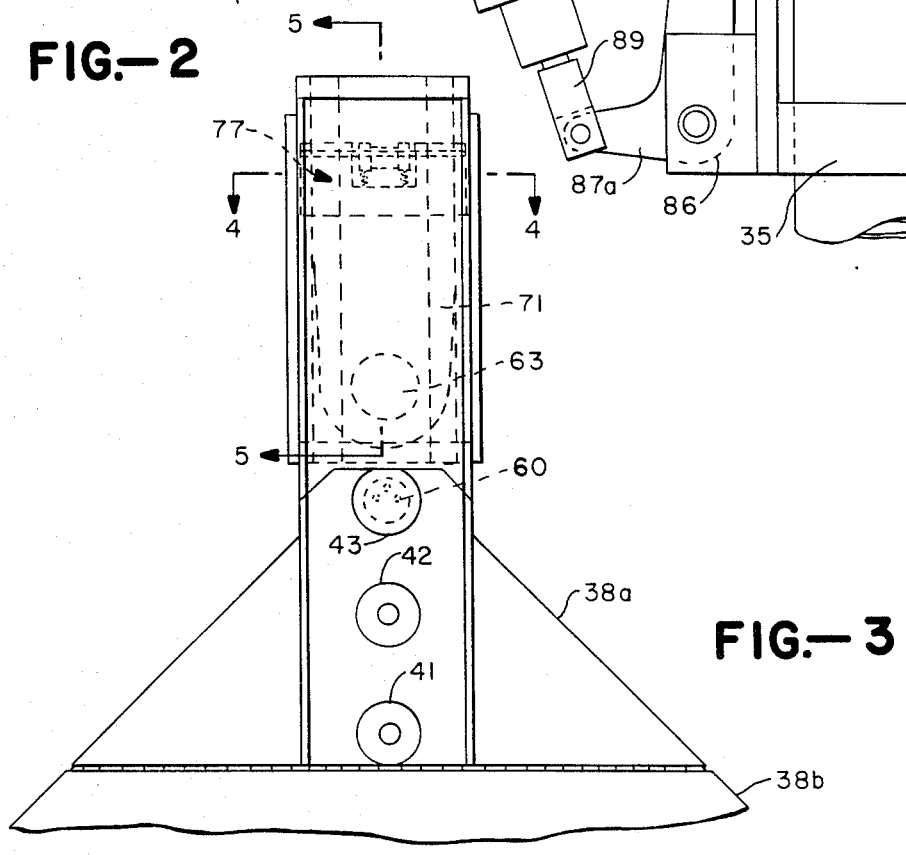
FIG. 3 is a schematic plan view of a portion of the operating assembly, namely that portion which includes the presser member and associated parts.

Each of the assemblies 10 consists of upper and lower structural members 31 and 32, which may be in the form of channels. They are secured to plate 33 which in turn is secured to the vertical member 14 by clamps 34 and 35. Side closure plates 37 are shown attached to the structural members 31 and 32. A support 38, upon which bags are deposited for processing, is carried by the forward end of structural member 32. The support 38 consists of two parts, 38*a* and 38*b*, which are normally coincident with a common plane, and connected by the hinge 39. As illustrated in FIG. 2 the structural members 31 and 32, and the support 38, slope downwardly from the central support member 14, for a reason that will be presently understood. Part 38*a* is shown provided with a resilient overlay 40, such as sponge rubber or like cellulous material.

The upper structural member 31 serves to mount a plurality of operators 41, 42 and 43, which in this instance are of the pneumatic cylinder-piston type. The operator 41 has its operating piston rod 44, secured to a clamping bar 47, the lower surface of which is provided with the resilient facing 48, made of sponge rubber or like resilient cellular material. The operator 42 has its piston rod 49 secured to the heat sealing member 51, which has electrical heating means for effecting a heat sealing operation of a desired pattern. The piston rod 52 of operator 43 is secured to the clamping member 53, which likewise has a resilient facing 54, and which carries out a pressing and sealing operation as will be presently described.

The support 38 is formed with an opening 55 that registers with the upper end of the filling head 56 that connects with pipe 22. The upper end of head 56 has an annular recess 57 which accommodates the resilient O ring 58. The O ring may be of the type commonly used for effecting seals between adjacent surfaces, and is made of suitable pliable synthetic rubber. The dimensions of the O ring are such that when relaxed, its upper rounded surface projects a short distance above the upper surface of the support member 38*a*.

The filling head 56 preferably incorporates a valve means which is opened at the beginning of a filling cycle and closed when the cycle is ended. It controls flow of a predetermined amount of liquid from the line 22. In this instance the valve is of the O ring type, (FIGS. 10 and 11) and includes a valve member 56*a* which is adapted to be moved into and out of a cylindrical seat 56*b*. The operator 56*c*, may be one of the electrical solenoid type, having a controlled energizing circuit. The corresponding liquid supply pipe 22 is provided with a metering device 56*d*, which may be of the turbine type, and which is adapted to close the valve when a predetermined amount of liquid has been supplied.

Assuming that the operators 41, 42 and 43 are of the pneumatic cylinder-piston type, their operating cylinders are connected to a source of pneumatic pressure, through solenoid operated control valves. It is assumed in this instance that each of the operators has spring means for returning their operating rods to retracted position, after being actuated. In addition to performing a pressing and sealing operation, member 53 is provided with a suction nozzle 59, which is connected to a source of pneumatic suction, under the control of a solenoid valve. A similar suction nozzle 60 is disposed in the support 38*a*, and is located below the nozzle 58. After a bag has been deposited upon the support 38, the end wall portions of the bag are caused to adhere to the nozzles 59 and 60, by application of suction, and member 53 is retracted to the position shown in FIG. 2, that end portion of the bag which is unsealed is opened in the manner illustrated.

Figure 7:
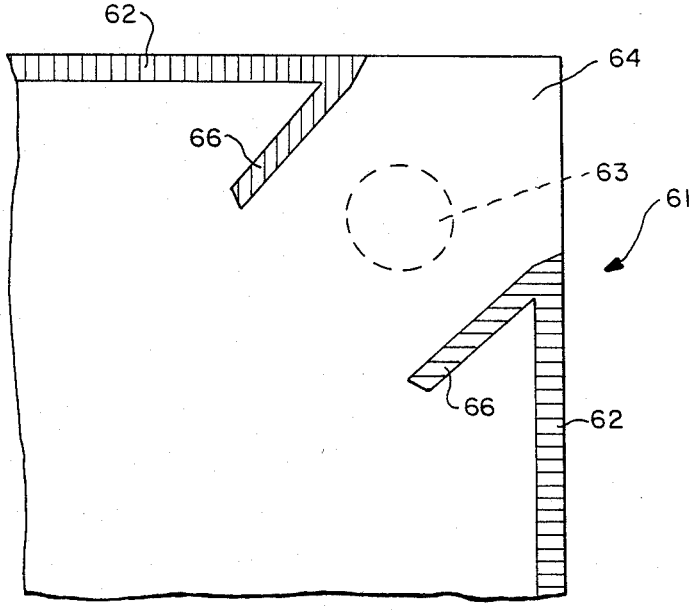
FIG. 7 is a detail in plan illustrating one corner of the bag, where the bag is provided with an unsealed portion.

U.S. Pat. No. 4,341,522, July 27, 1982, discloses a machine for the manufacture of bags or pouches which are suitable for use with the present invention. The material may be polyethylene laminate film, and the bag constructed with flat side walls heat sealed along their peripheral edges. A portion of such a bag 61 is shown in FIG. 7. The heat sealed areas 62 extend about the periphery of the bag, and one corner portion of the bag is left unsealed. The lower side wall of this corner portion is provided with an opening 63, which is formed when the bag is made. The unsealed region 64 preferably is tapered toward the interior of the bag, and is defined by the heat sealed areas 66.

Figure 13:
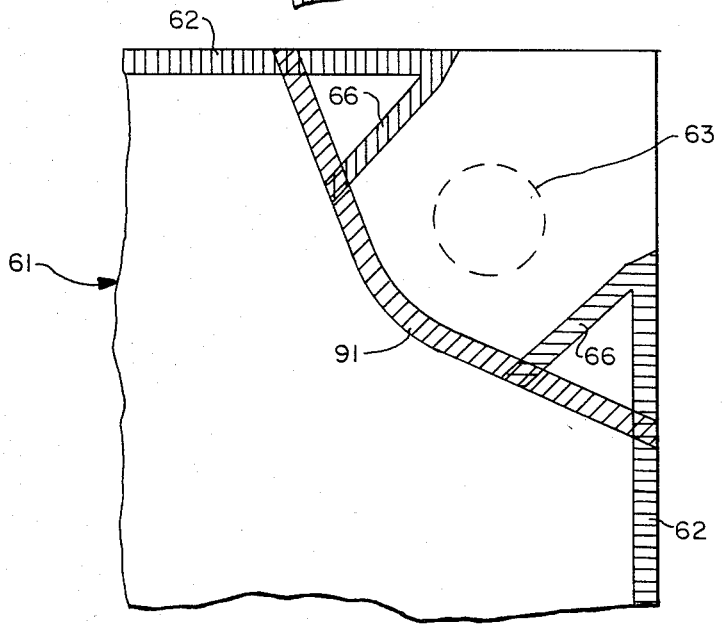
FIG. 13 is a detail in plan showing the seal areas after sealing of the filled bag.
Figure 14:
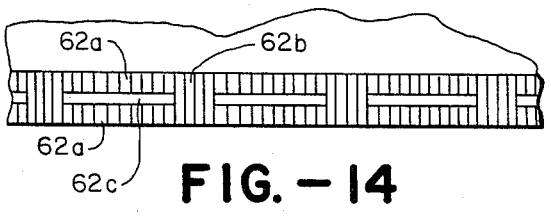
FIG. 14 is an enlarged detail showing another form of seal.

FIG. 14 illustrates another manner in which the peripheral heat sealed areas can be made. In place of the simple seal areas shown in FIG. 13, parallel and spaced areas 62*a* are provided, together with spaced blocking areas 62*b* which extend between the areas 62*a*. This provides short channels 62*c* which receive any liquid leakage which possibly may occur into one of the areas 62*a*. If such leakage should occur into one of the spaces 62*c*, it is blocked by the areas 62*b*. In practice, when a bag is properly deposited upon the support 38, the filling hole 63 is in registration with the upper end of the filling head 56. The peripheral margin of the bag surrounding the hole 63 is in contact with the resilient O ring 56.

Figure 8:
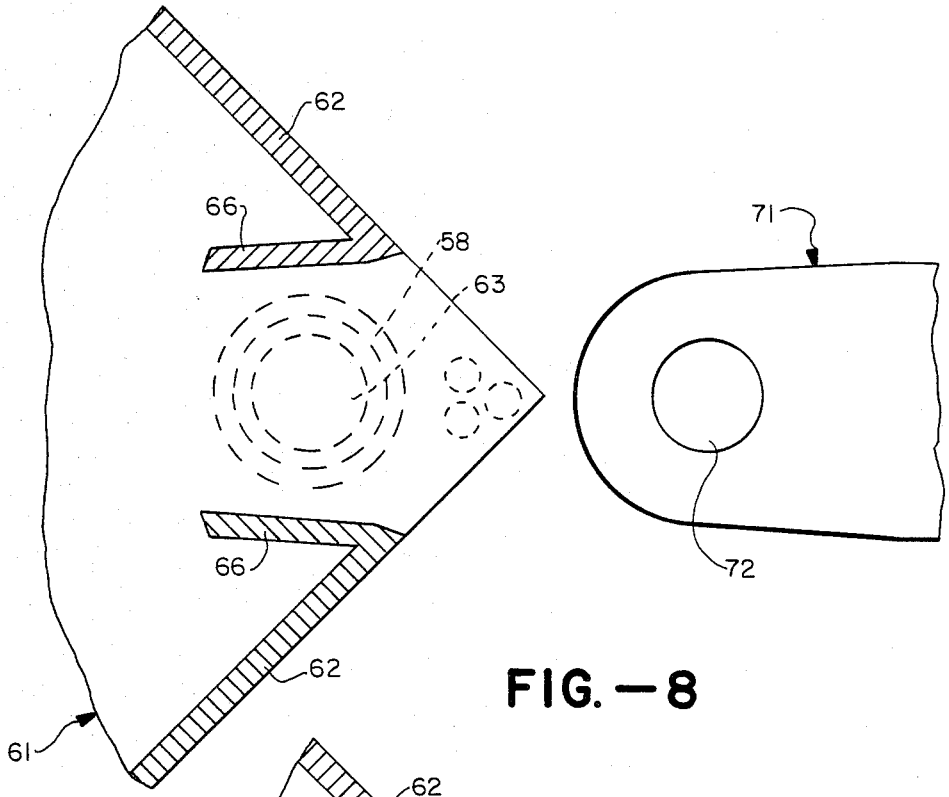
FIG. 8 is a schematic view illustrating the location of a bag immediately before a presser member is inserted into the opening of the unsealed portion.
Figure 9:
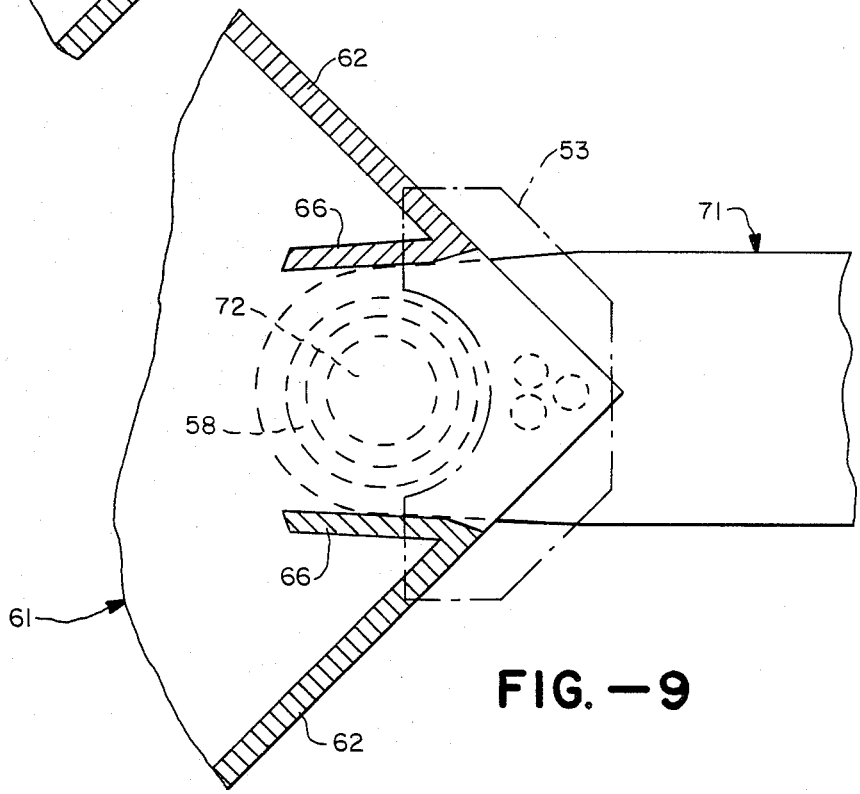
FIG. 9 is a view like FIG. 6 but showing the presser member introduced into the bag.

Preparatory to introducing liquid into the bag by way of the pipe 22, means is provided for pressing the lower wall of the bag against the O ring 57, thus establishing a seal between the end of the filling head 56 and the adjacent peripheral margin of the lower side wall. The presser means illustrated for performing this function consists of a member 71 in the form of a flat tongue which connects with actuating means whereby it is projected into the bag (FIG. 9) through the unsealed portion, and pressed downwardly to urge the lower wall of the bag into intimate sealing contact with the resilient O ring. After filling the bag, member 71 is retracted to the position shown in FIG. 8. It has an opening 72 in its forward portion which is of a diameter that is comparable to the bag opening 63. Likewise it is tapered comparable to the tapor formed by the seal areas 66 shown in FIG. 5. When projected into the bag as shown in FIG. 7, the forward tapered end of the presser member is caused to be snugly fitted between the sealed areas 66 of the bag. Also the opening 72 is in registration with the bag opening 63. After being projected to the position shown in FIG. 9, the presser member 71 is forced downwardly to cause an effective seal to be established between the lower wall of the bag and the resilient O ring 56.

The means for guiding and actuating the presser member 71 is illustrated in FIGS. 3–6. A guide track is formed by the parallel rods 76, which are mounted between the members 31 and 32. A slide assembly 77 is carried by rods 76 and in turn serves to carry the presser member or tongue 71.

Figure 4:
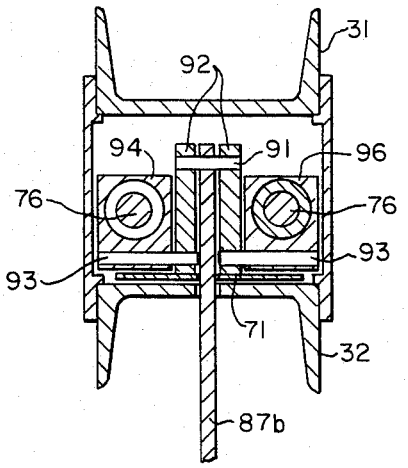
FIG. 4 is a cross-sectional view taken along the line 44 of FIG. 3.
Figure 5:
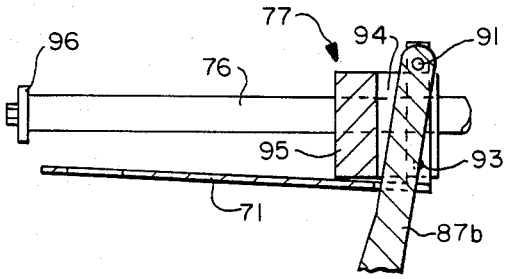
FIG. 5 is a cross-sectional view taken along the line 5—5 of FIG. 3.
Figure 6:
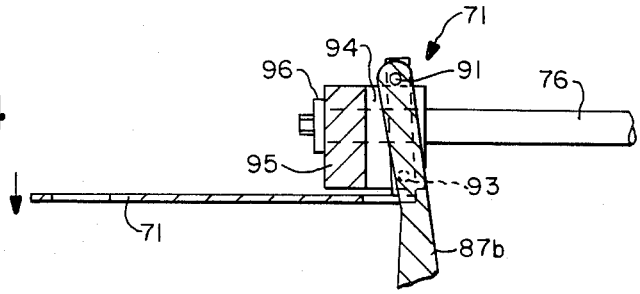
FIG. 6 is a view like FIG. 5 showing a different operating position of the parts.
Figure 10:
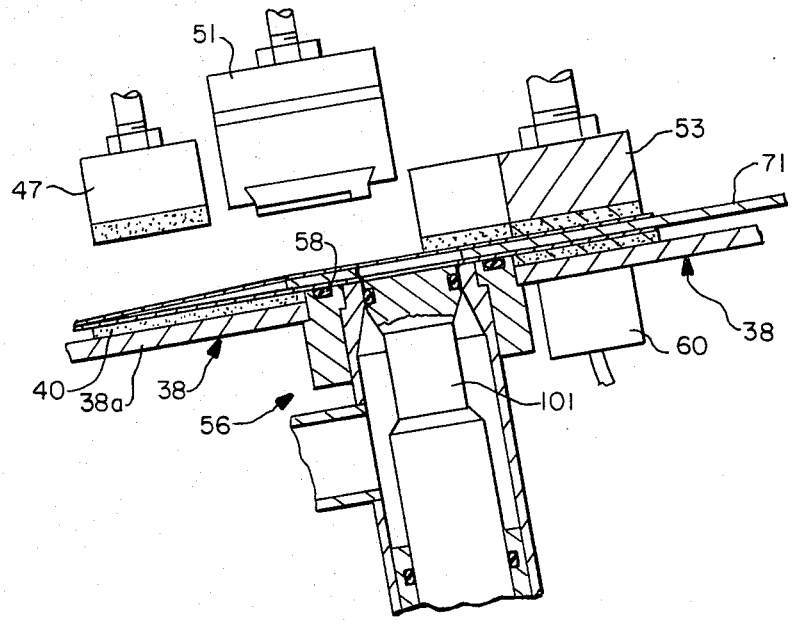
FIG. 10 is a schematic view in section, except that it shows the position of parts of the operating assembly immediately before introducing liquid into the bag.
Figure 11:
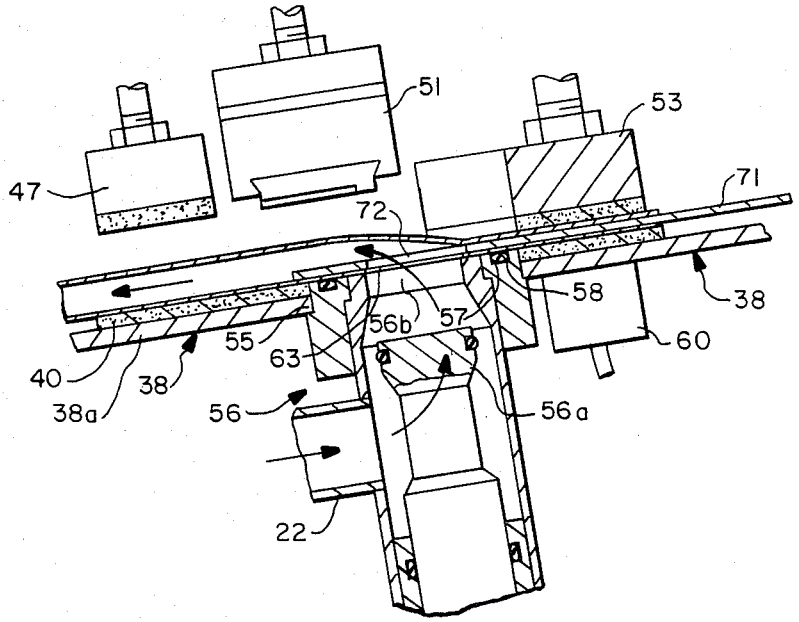
FIG. 11 is like FIG. 10, except that it shows the position of parts of the operating assembly during filling of the bag.

Referring to FIG. 2 a bracket 86 is carried by a clamp 35, and forms a pivotal mounting for the lever 87. A pneumatic operator 88, such as one of the cylinder-piston type, is anchored at one end to the structural member 32, and its operating rod 89 is pivotally connected to the arm 87*a* of the lever 87. The other arm 87*b* of lever 87 is pivotally connected by pin 91 with the members 93 (FIGS. 4–6). The tongue-like presser member 71 has its one end portion attached to the members 93, as illustrated in FIG. 4. The arrangement is such that the presser member 71 is carried in such a manner that when it is initially projected into the bag it is raised a sufficient amount to clear both the upper and lower side wall portions of the bag. After reaching its projected position the presser member 71 is lowered against the lower wall of the bag. Then member 53 is lowered and pressed against the bag. This causes the presser member 71 to be pressed downwardly to urge the underlying side wall portion into sealing engagement with the O ring and to simultaneously press the side walls of the bag about the upper and lower surfaces of the presser member, and about the edges of this member (FIG. 10). In other words a seal is established between the bag and the filling head 56 between the peripheral margin of the lower side of the bag surrounding the bag opening 63, and the resilient O ring 58. At the same time the bag is sealed about the presser member as shown in FIGS. 10 and 11.

Figure 12:
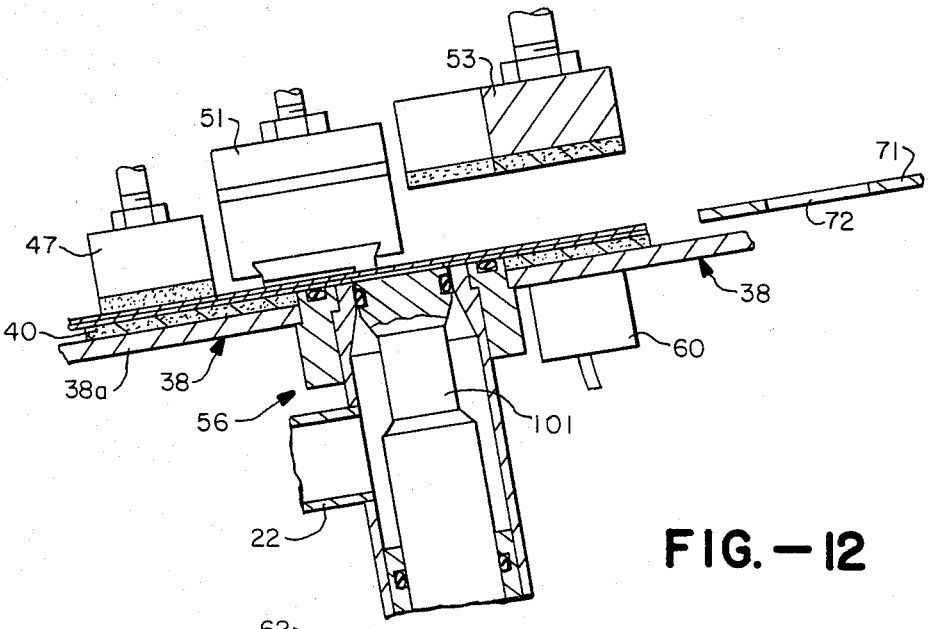
FIG. 12 is a view like FIG. 10, except that it shows the position of parts of the operating assembly after filling and during sealing of the bag.

Further with respect to the slide assembly 77, the main body of the assembly includes the portions 90 which slidably engage the rods 76 and are connected by portion 91 (FIG. 5). Portions 90 are pivotally connected to members 92 by pins 93. Spring 94 acts to elevate member 71 when the latter is retracted. However when moved to the limit of its projected position, portion 91 engages a stop 96 whereby slight further movement of lever arm 87*b* serves to compress spring 93 and thereby cause the free end of member 71 to be lowered. Member 53 remains in the position illustrated in FIG. 11 while a measured amount of liquid is being introduced into the bag through pipe 22 (FIG. 10). During the filling operation the member 47 is retracted or raised, whereby it does not interfere with the flow of liquid toward ther bottom of the bag. After a measured amount of liquid has been introduced, it is desirable to have a short pause to permit drainage of liquid into the main portion of the bag. Such drainage is facilitated by the downward slope imposed by the downwardly sloped support 38. Clamping member 47 is then lowered to hold the filled bag on the support 38 and suction is released from nozzles 59 and 60. Member 53 is then raised. The tongue-like pressure member 71 is retracted, and the heat sealing member 51 is lowered into contact with the bag to perform a heat sealing operation between the areas 66. Such a seal area is illustrated at 97 in FIG. 12. During filling of the bag the part 38*b* of the support 38 is gradually lowered whereby upon release of the bag by retraction of member 47, the bag slides off of the support and the assembly 10 is in condition for receiving another bag for filling.

Figure 16:
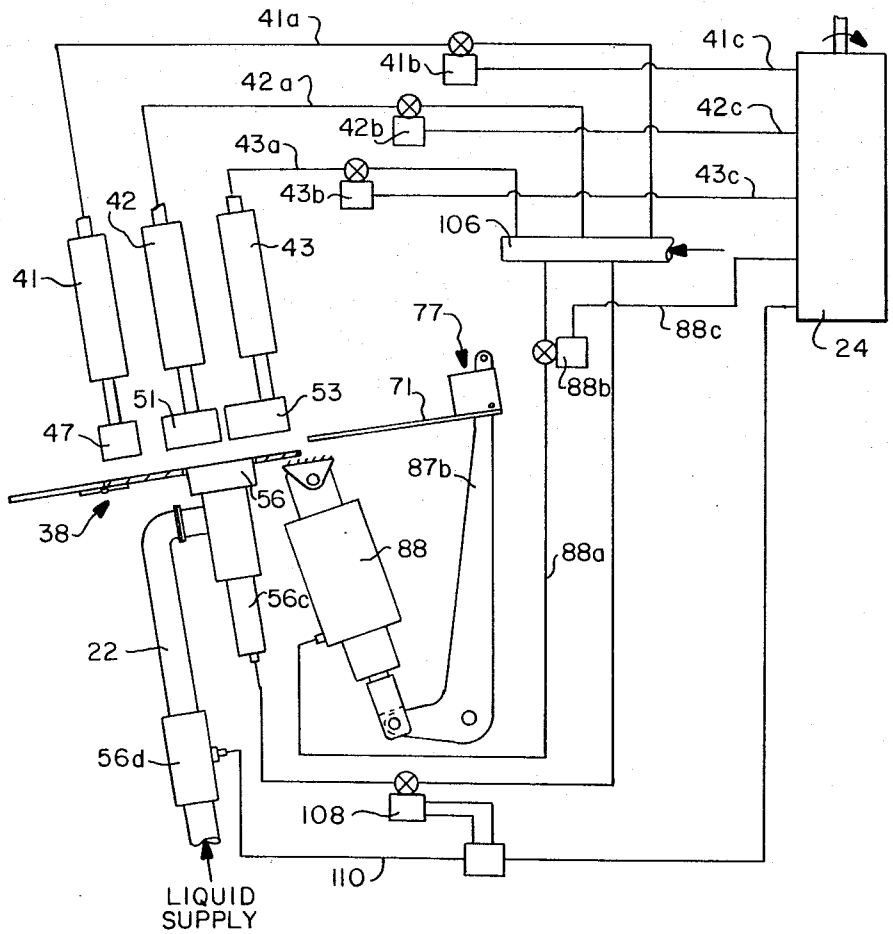
FIG. 16 is a schematic diagram showing pneumatic and electrical connections for programmed operation.
Figure 15:
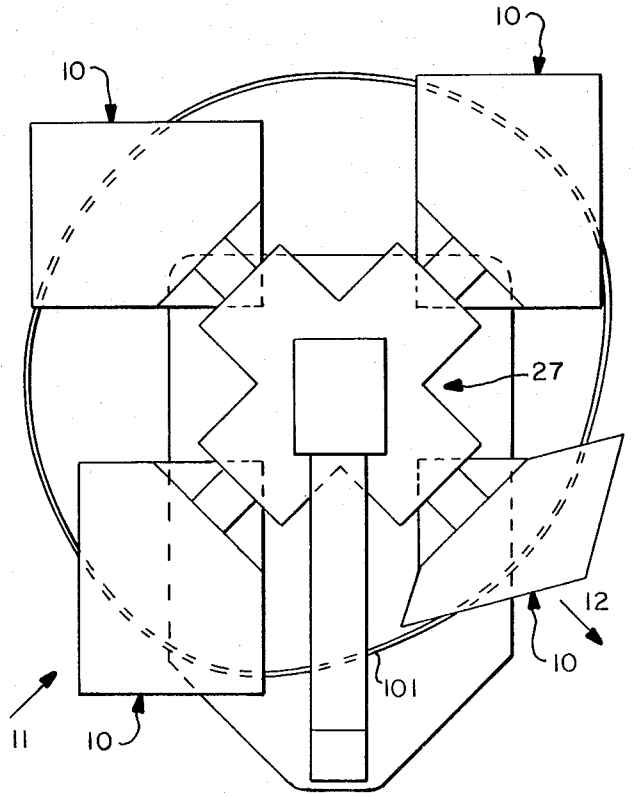
FIG. 15 is a schematic plan-view of a machine having four operating assemblies.

FIG. 1 illustrates two assemblies 10 located 180° apart. While one assembly can be used, particularly in instances where it is manually supplied with bags, it is desirable to use a number of assemblies rotated about the central support 14, to obtain a greater capacity. Thus in a particular instance four such assemblies can be employed as shown in FIG. 15. When a bag is introduced into an assembly, the support part 38*b* is in the position shown in FIG. 1. It is supported in this position by wheel 101, which operates upon the track 102. The configuration of this track depends upon the number of assemblies employed and the desired discharge position. In general and with reference to schematic FIG. 1, the track 102 may be sloped downwardly from the loading position, as indicated at 102*a*, and then before the assembly reaches the discharge position, it may be sloped downwardly more steeply as indicated at 102*b*. This lowers the support portion 38*b* to a sufficient angle to permit the bag to slide off of the support. In schematic FIG. 16, the track 102 is continuous and serves to cause discharge of the filled bags from each of the assemblies, as they reach the discharge station.

As previously explained, the operating cycle of the machine is programmed by suitable means which may be electromechanical, or programmed electronic means of the computer type. The schematic diagram of FIG. 16 assumes that rotary switching means 24 is being used to control the programming of the various operations. The pneumatic operators 41, 42 and 43 are pneumatically connected by lines 41*a*, 42*a* and 43*a*, to the solenoid operated valves 41*b*, 42*b* and 43*c*. The solenoids of each of these valves are in turn connected to an electric operating circuit, represented by the cables 41*c*, 42*c* and 43*c*. The valves 41*b*, 42*b* and 43*b* are of the type that vent the lines 41*a*, 42*a* and 43*a* to the atmosphere, when the valves are closed. The valves are pneumatically connected to the manifold 106 which connects with a source of pneumatic pressure. The pneumatic operator 88 is also pneumatically connected by line 88*a* to the solenoid operated valve 88*b*, which in turn has its electrical circuitry extending to the rotary programmer 24, by way of the circuitry cable 88*c*. The pneumatic operator 66*c* for the valve of the filling head 56, is similarly connected to the manifold 106 through the solenoid operated valve 108. However in this instance the solenoid is electrically energized under the control of the control box 109, which in turn is programmed by the programming means 24. The arrangement is such that the programming means 24, acting through the control device 109, opens the valve 108 to activate the operator 56*a* to effect opening of the filling head valve. This occurs at the commencement of a filling operation. After a predetermined amount of liquid has been supplied as determined by the metering device 56, the circuitry represented by cable 110 acting through the control devices 109, serves to close the valve 108.

Additional operations that are programmed, can likewise be programmed by the means 24. Particularly the various suction nozzles can be connected to suction lines under the control of solenoid valves, which in turn are controlled by the means 24.

Figure 17:
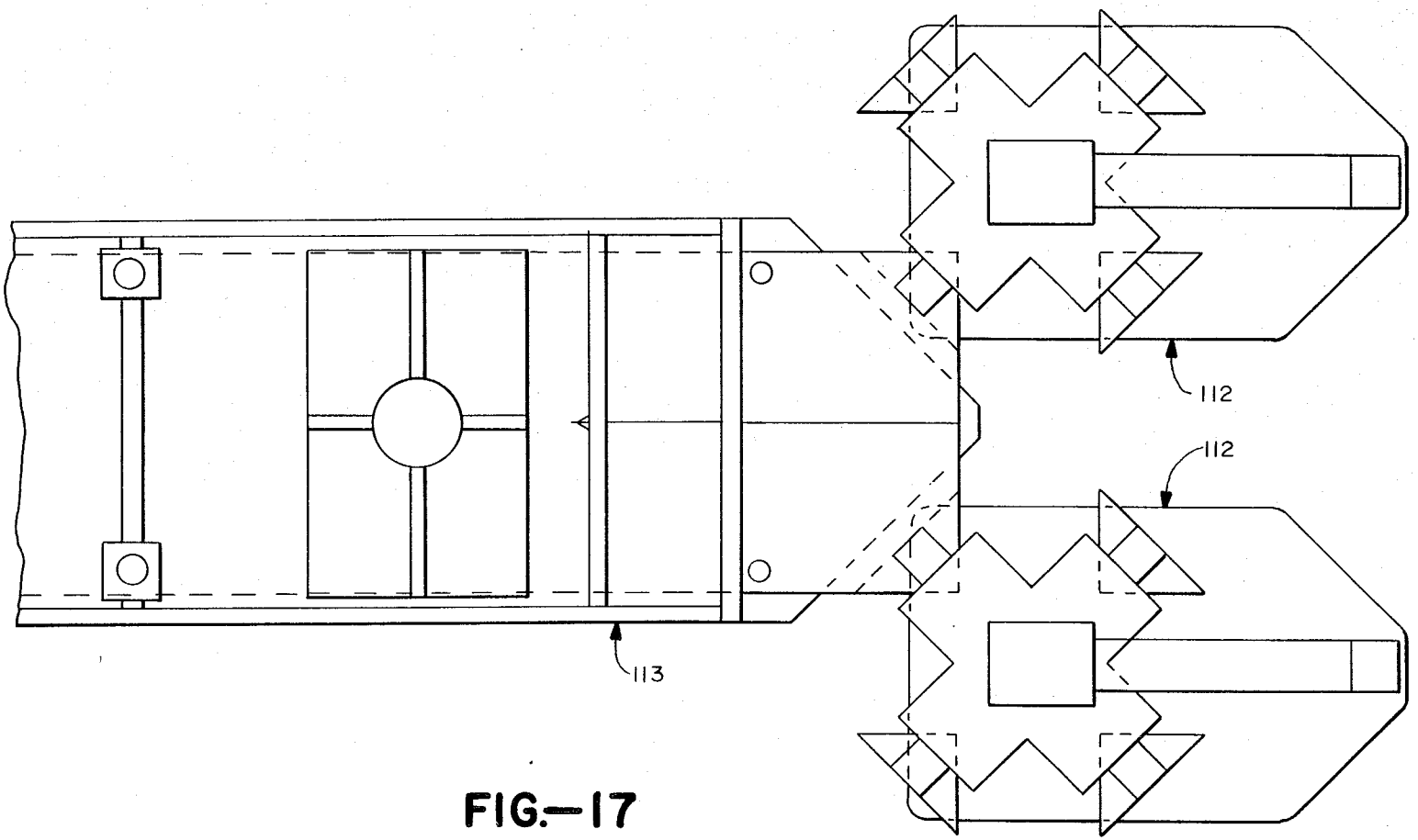
FIG. 17 is a schematic plan view of two machines being fed by a bag making machine.

Suitable driving means is provided for causing the assemblies 10 to be rotated about the central axis of the machine, with indexing in accordance with the number of assemblies employed. Assuming that the machine is fed manually at the feed station, then a control button can be provided whereby after manual positioning of a bag, the operator presses the start button, and thereafter the complete cycle of operation is carried out, with the filling of the bag, its discharge, and the return of the assembly to the feed position, where it automatically stops. If the machine is fed automatically from a bag making machine, as disclosed in U.S. Pat. No. 4,314,654, indexing of the assemblies is synchronized with the delivery of bags from the bag making machine. As schematically illustrated in FIG. 17, two machines 112 can be installed side by side, and both machines fed from the bag making machine 113. The machine in this instance should be such that it supplies two side by side bags to the operating assemblies of the two machines, and the two machines must be indexed in synchronism with respect to each other and with respect to the bag making machine. Also the two machines are rotated in opposite directions. The arrangement of FIG. 17 makes it possible to double the overall capacity.

A complete cycle of operation of the assembly 10 is as follows. A bag constructed substantially as explained in connection with FIG. 7, is deposited upon the support 38, with its unsealed end portion overlying the suction head 60, and with the clamping member 47, the heat sealing member 51, and the member 53 in their raised or retracted positions. Also at this time the clamping member 47 may be lowered to clamp the bag against the support 38. The member 53 is then lowered into contact with the upper side wall of the bag immediately overlying the suction nozzle 60, while suction is applied to the nozzle 59 forming a part of this member and to nozzle 60. Immediately thereafter member 53 is retracted upwardly with the result that the upper and lower side walls are separated in the manner shown in FIG. 2. The presser member 72 is now projected into the bag by activating the operator 88, and the opening 72 in the presser member is brought into registration with the opening 63 in the lower side of the bag and with filling head 56. Member 53 is then again lowered to bring the upper side wall down upon the presser member and to apply sufficient force to cause the upper and lower sides of the bag to be pressed about the presser member. At the same time the presser member is urged toward the resilient O ring 53, to establish an effective seal between the upper end of the filling head 56 and the lower side of the bag, namely the perimeter area about the hole in the bag. Clamping member 47 is now raised, air is removed from the bag by suction that may be applied through a duct (not shown) in the valve member 56*a*, and a predetermined amount of liquid supplied to the bag through the pipe 22 and filling head 56. When filling of the bag has been completed, there may be a short pause to permit liquid to drain into the lower portion of the bag. The heat sealing member 51 is then lowered into contact with the bag to form a heat seal as represented by the area 91 of FIG. 13. During or immediately following the heat sealing operation and subsequent retraction of heat sealing member 51, member 47 is returned to clamping engagement with the bag and the member 53 is retracted. When the filling and sealing operations have been completed and the bag moved to the discharge station, clamping member 47 is raised and the complete sealed and filled bag is discharged. During the filling operation the support part 38*b* is gradually lowered, while the bag is being moved to the discharge station.

Figure 18:
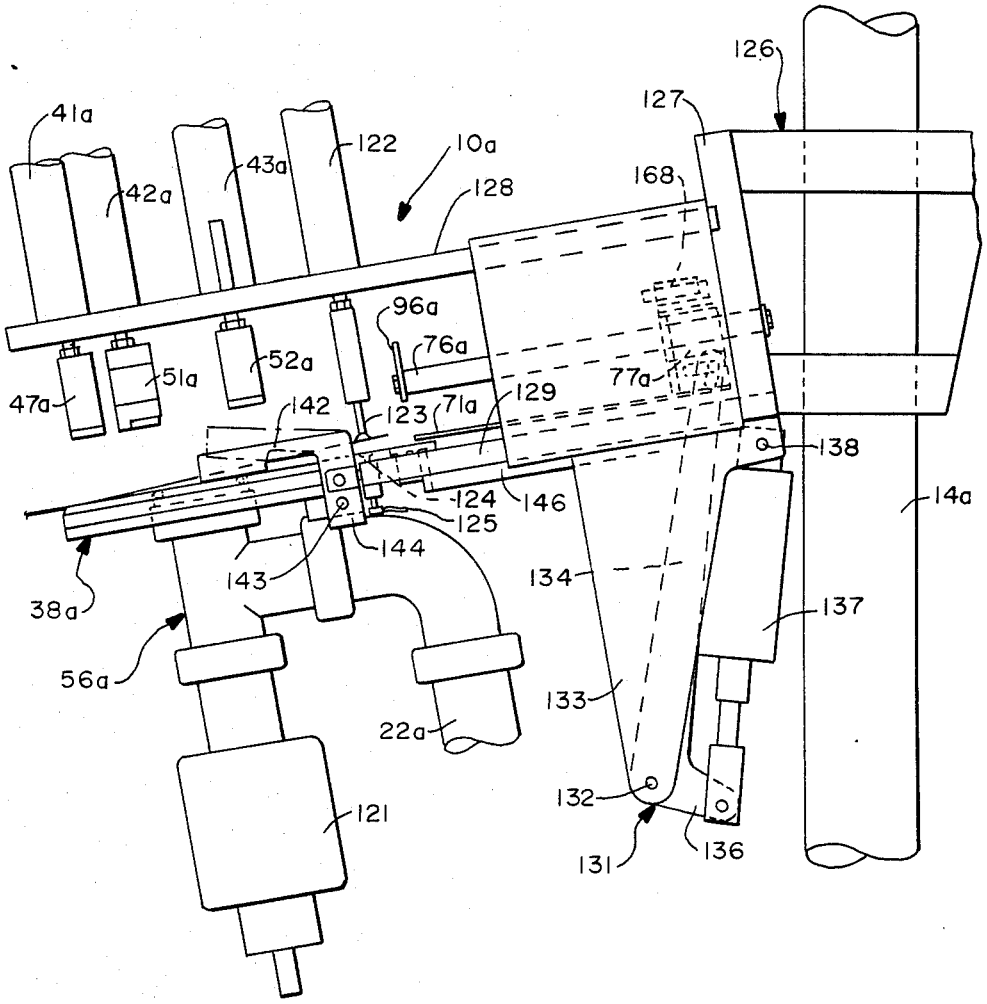
FIG. 18 is a side elevation of another embodiment of the operating assembly.
Figure 19:
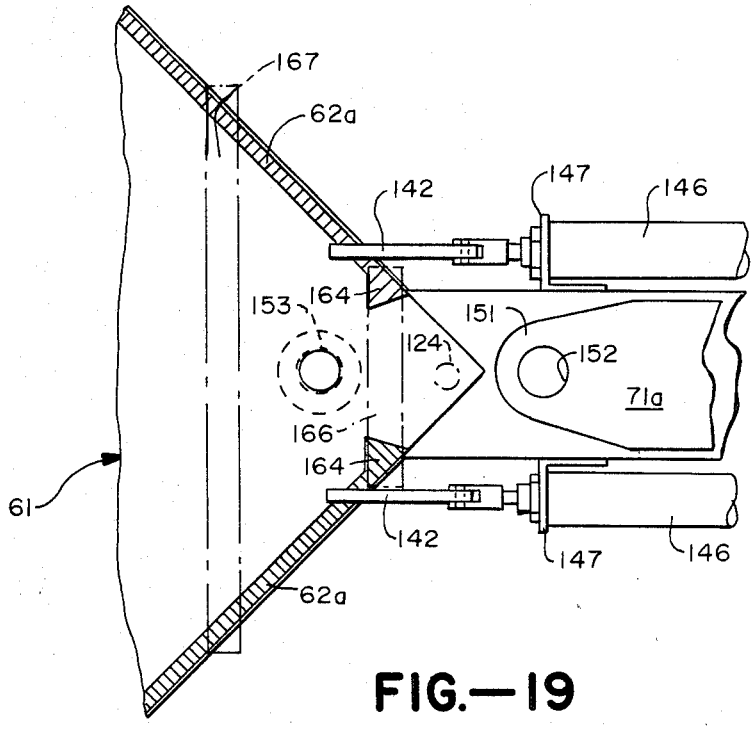
FIGS. 19 and 20 are schematic plan views showing different operating positions preparatory to filling of the bag.
Figure 20:
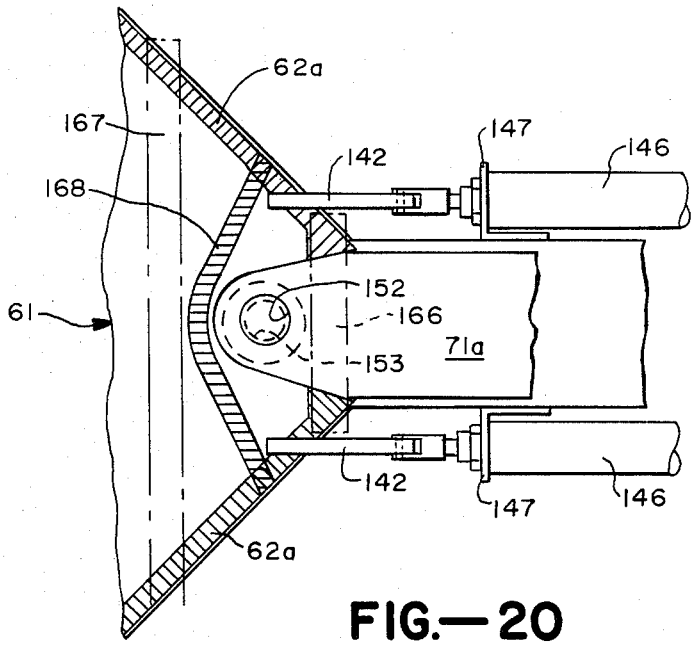

Another embodiment of the assembly 10 is illustrated in FIGS. 18–20. In this instance the bag support 38*a* is generally the same as the support 38 previously described. Likewise the pneumatic operators 41*a*, 42*a* and 43*a* are generally the same as in the previous embodiment. The clamping member 47*a*, heat sealing member 51*a* and clamp 52*a* are secured to the operating rods of the pneumatic operators 41*a*, 42*a* and 43*a*, and they correspond generally to the clamping member 47, heat sealing member 51 and clamping member 52 of FIG. 2. The filling valve 56*a* is associated with the support 38 in substantially the same manner as described in connection with FIG. 2 for the valve 56. The valve when open is supplied with liquid delivered through the pipe 22*a*. The filling valve 56*a* is opened and closed responsive to actuation of the operator 121. It is assumed that the valve in this instance is provided with a duct through which suction can be applied as will be presently explained. The pneumatic operator 122 serves to lower and raise the suction cup 123. Another stationary suction cup 124 is located below the cup 123, and is associated with the support 38. Line 125 leading from the lower cup, is connected with the same controlled source of suction as suction cup 123.

The entire assembly 10*a* is carried by a structure 126, which includes upper and lower clamps for attachment to the vertical pipe 14*a*. The stucture includes the plate 127, to which the upper and lower supporting member 128 and 129 are secured. Plate 128 serves to mount the pneumatic operators 41*a*, 42*a*, 43*a* and 122, whereas the plate 128 carries the support 38*a*, the filling valve 56*a*, and related parts. The pressure member or tongue 71*a* is generally the same as in FIG. 2, and is carried by the slide member 77*a*, which in this instance consists of a simple body member. This slide in turn is slidably carried by the rods 76*a*. The mechanism for reciprocating the tongue 71*a* and the slide member 77*a*, consists of the lever 131, which is pivotally attached at 132 to the stationary web 133. The arm 134 of lever 131 is connected to the slide member 77*a* in the manner as shown in FIG. 18. The arm 136 of lever 131 is pivotally connected to the operating rod of the pneumatic operator 137, which in turn has a pivotal connection 138 with the structure 126. The source of pneumatic pressure for the operation is controlled whereby when the operator is actuated, it provides sufficient thrust for normal advancing movement of the tongue 71*a* to the limit of its permissible travel (limited by engagement of slide 77*a* with stop 96*a*).

In addition to the parts described above, FIG. 18 shows clamps 142 which are attached by pivotal connections 143 to the sides of the supporting means 38. Each clamp is L-shaped as shown in FIG. 18, and the lower arm 144 of each clamp is pivotally connected with the operating rod of a pneumatic operator 146. These operators are shown carried by the mounting brackets 147. By the actuation of operators 146 under application of controlled air pressure, the two clamps 142 are moved from their raised and disengaged positions as shown in dotted lines in FIG. 18, to their clamping positions shown in solid lines.

The forward end portion 151 of the tongue 71*a* is convergent as illustrated in FIGS. 19 and 20, and is provided with the opening 152. During a filling operation this opening is in registration with the opening in the lower wall of the bag and the discharge opening of valve 56*a*. In FIG. 19 the valve opening is indicated in dotted lines at 153, and in FIG. 20 the openings 152 and 153 are in registration with each other and with the opening in the lower wall of the bag. As will be presently explained this registration is established immediately before a bag filling operation, and after normal advancing travel of the tongue and slide member.

It will be noted from FIGS. 19 and 20 that the sealing areas of the bag are somewhat different in configuration than the first described embodiment shown in FIG. 7. The perimeter sealed areas 62*a* are substantially the same as in FIG. 7. However the sealed areas 164 terminate to provide inwardly convergent edges, that are comparable to the convergent edges of the tongue portion 151. Therefore, as the tongue is inserted into the bag opening, it seats itself upon the edges of the sealed areas 164.

A complete cycle and mode of operation of the above embodiment is as follows. A bag is deposited upon the support and is accurately positioned substantially as shown in FIG. 19. Guide surfaces or pegs may be provided for this purpose. At this time the tongue 71*a* is retracted, and the clamping members 142 are raised out of engagement with the bag. Likewise the clamping members 47*a*, 51*a* and 52*a* are raised. Operators 146 and clamping members 142 are then actuated to cause members 142 to engage the bag on opposite sides of the bag opening, substantially as illustrated in FIG. 19. Suction is applied to the upper and lower vacuum cups, and the upper cup is lowered to engage the upper wall of the corner of the bag. The positions of engagement are illustrated by dotted lines in FIG. 19. The upper suction cup 123 is then raised to open the corner of the bag, whereby it is in condition to accommodate the tongue 71*a*. The operator 137 is then actuated to advance the tongue 71*a* into the open corner of the bag, thus causing the portion 51 of the tongue to seat itself on the sealed areas 164. The pneumatic pressure applied to operator 137 is such that it permits the tongue to stop further advancing movement. At that time the opening 152 in the tongue is in registration with the filling hole in the lower wall of the bag, and with the filling valve opening 153 (FIG. 19). Immediately before final seating of the tongue on the convergent edges of seal areas 164, suction to the cups 123 and 124 is discontinued, and cup 123 is retracted, whereby the cups no longer adhere to the bag. Operator 43*a* is then energized to lower the clamping member 52*a* upon the bag and tongue, whereby the bag is clamped along the area 166 indicated in FIGS. 19 and 20. As explained in connection with the first described embodiment, clamping in this fashion serves to press the tongue downwardly to establish a seal with the filling valve, and also to establish a seal about the tongue between the bag seal areas 164. Suction is then applied to the interior of the bag for a short time to substantially remove all air. It is convenient and preferable to apply such suction through a duct extending through the stem of the filling valve. Liquid is now introduced into the bag through pipe 22*a* and the filling valve 56*a*, until the valve has received a predetermined measured amount. At the conclusion of the filling operation, operator 41*a* is activated to lower the clamp 47*a* which serves to press the upper and lower walls of the bag together to establish a temporary closure along the area indicated at 167 in FIGS. 19 and 20. The heat sealing member 51*a* is then lowered and pressed against the bag by actuating the operator 42, whereby a sealed area 168 is established between the peripheral seals 62*a*. Upon completion of the sealing of the bag, the heat sealing member 51*a* is retracted. Clamping member 52*a* is then retracted and the tongue 71*a* is withdrawn by actuating the operator 137. When the assembly 10*a* in its rotation reaches a discharge station, the clamp 47*a* is released, whereby the bag is free to discharge from the machine.

In some instances a malfunction may occur, such as an improperly heat sealed or positioned bag which prevents normal seating of the tongue on the seal areas 164. To prevent the liquid from being supplied under such conditions, an electrical switch 168 is shown mounted on the slide 77*a*. Its spring urged operating member is disposed to engage the stationary member 96 when the slide proceeds farther than its normal advancing movement. Electric circuitry controlled by such operation of switch 168 prevents the filling cycle from taking place.

It will be evident that the operation of the embodiment shown in FIGS. 18, 19 and 20 can be controlled by programming means as described for the first embodiment.

What is claimed is:

1. A method for filling pouches or bags with liquid, the bags being made of flexible film material with one unsealed end portion, one side wall of the bag adjacent said unsealed end portion having a filling opening, comprising the steps of positioning a bag on supporting means with the filling opening facing downwardly, separating the side walls of said unsealed end portion, inserting a presser member having an opening, into the open end of the bag, forming registration between the filling opening the opening in the pressure member and means for introducing liquid into the bag, causing the presser member to press the peripheral area of said one wall in an area surrounding the filling opening to form a seal between said one wall and liquid introducing means closing the unsealed end portion about the pressure member, introducing a measured amount of liquid through the filling opening and into the bag to fill the same, and then sealing the filling opening and the unsealed end portion.

2. A method as in claim 1 in which the unsealed end portion is a corner portion of the bag.

3. A method as in claim 1 in which before and during introduction of liquid into the bag, the side walls of the unsealed end portion are closed in an area between the filling opening and the adjacent extremities of said side walls.

4. A method as in claim 3 in which the sealing of the filling opening and the unsealed end portion after filling of the bag is carried out by a heat sealing operation.

5. A method as in claim 4 in which the means for introducing liquid is a filling head connected to a source of liquid and which has a passage for conducting liquid from one end face of the head, said one face of the head having resilient annular sealing means, the method further comprising pressing the peripheral area of said one side wall of the bag extending about the periphery of the filling opening toward said one face of the head to form a seal between the head and the periphery of the filling opening during filling of the bag.

6. A method as in claim 1 in which the unsealed end portion of the bag is closed about the presser member during a filling operation.

7. A method as in claim 6 in which the unsealed end portion of the bag is defined by areas in which the walls of the bag are sealed together to form an inwardly convergent tapered opening and against which the side edges of the presser member are seated during a filling operation.

8. A machine for filling bags made of flexible film material with liquid, the bag having an unsealed end portion and a filling opening in one side wall of the bag adjacent the unsealed end portion, the machine and its operating cycle comprising means for supporting the bag with the filling opening faced downwardly, a filling head having an upwardly faced end disposed to register with the filling opening of the bag, means for opening the unsealed end portion, a presser member, means for moving the presser member from a retracted position to a projected position within the open unsealed end portion of the bag, means for closing the end portion of the bag about the presser member when projected, and for urging the presser member against the lower side wall of the bag in a region surrounding the filling opening, the presser member having an opening located in registration with the bag opening and filling head when in projected position, the filling head being adapted for communicating with a source of liquid for filling the bag, and means for sealing the filling opening and said end portion of said bag after the bag has been filled.

9. A machine as in claim 8 together with means for securing the bag to the supporting means, such securing means being releasable to permit removal of the bag after filling and sealing of the bag.

10. A machine as in claim 8 in which the said end face of the filling head includes an annular resilient seal ring, said presser member serving to compress the seal ring to form a seal between the head and the area of the adjacent bag wall surrounding the filling opening of the bag.

11. A machine as in claim 8 in which the support means consists of first and second parts, a hinge serving to attach the two parts on a horizontal hinge axis, the one part being fixed and underlying that part of the bag into which liquid is introduced, the second part underlying the remaining part of the bag, and means for maintaining the second part substantially coincident with the plane of the first part during the initial phase of the operating cycle, and for lowering the second part as the bag is being filled.

12. A machine as in claim 8, together with means including an electrical switch disposed to be operated when the presser member advances beyond normal position.

13. A machine as in claim 9, together with separate means for clamping and restraining areas of the bag on the supporting means, said areas being located on opposite sides of the unsealed end portion.

14. A method as in claim 7 in which end portions of the bag on opposite sides of the sealed areas forming said convergent tapered opening are pressed against the supporting means to restrain said areas against movement during seating of the pressor member in said convergent tapered opening.

15. A method as in claim 7 in which liquid is not supplied if the presser member is advanced beyond its normal projected position.

16. A method as in claim 1 in which the liquid is supplied to the bag through an opening in the presser member.

17. A machine as in claim 8 in which separate releasable clamping means is provided for retaining the open end portion of the bag on areas adjacent the sides of said unsealed portion.

18. A machine as in claims 8 in which the presser member is in the form of a tongue having an opening in its forward end portion.

19. A machine as in claim 8, together with heat sealing means for sealing the end portion of the bag after a bag filling operation.

* * * * *